US011913231B2

(12) United States Patent
Daley

(10) Patent No.: US 11,913,231 B2
(45) Date of Patent: Feb. 27, 2024

(54) DEVICE AND ASSOCIATED METHOD FOR DOWNSPOUT ALIGNMENT

(71) Applicant: Daley Design + Build, LLC, Cincinnati, OH (US)

(72) Inventor: Graeme R. Daley, Cincinnati, OH (US)

(73) Assignee: Daley Design + Build, LLC, Cincinnati, OH (US)

( * ) Notice: Subject to any disclaimer, the term of this patent is extended or adjusted under 35 U.S.C. 154(b) by 225 days.

(21) Appl. No.: 17/687,753

(22) Filed: Mar. 7, 2022

(65) Prior Publication Data

US 2022/0298797 A1 Sep. 22, 2022

Related U.S. Application Data

(60) Provisional application No. 63/163,984, filed on Mar. 22, 2021.

(51) Int. Cl.
*E04D 13/08* (2006.01)
*E02D 31/06* (2006.01)

(52) U.S. Cl.
CPC ..... *E04D 13/08* (2013.01); *E02D 31/06* (2013.01); *E04D 2013/084* (2013.01); *E04D 2013/0806* (2013.01)

(58) Field of Classification Search
CPC ..... E04D 13/08; E04D 2013/0806; E04D 2013/084; E02D 31/06; E02D 31/02
USPC ..... 52/16
See application file for complete search history.

(56) References Cited

U.S. PATENT DOCUMENTS 4,074,684 A * 2/1978 Biesel ..... E03F 5/042 137/593
4,136,500 A * 1/1979 DiFiore ..... E04B 1/7023 52/169.5
4,391,071 A * 7/1983 Schantz ..... E04B 1/7023 52/287.1
4,757,651 A * 7/1988 Crites ..... E04B 1/7023 52/302.3
4,865,069 A * 9/1989 Lacey ..... F04F 10/00 405/36
4,925,342 A 5/1990 Hendy
5,056,281 A 10/1991 McCarthy
5,444,950 A 8/1995 Kelly et al.
5,607,124 A * 3/1997 Earley ..... E04D 13/08 248/48.1
6,241,421 B1 6/2001 Harvie et al.
7,614,192 B2 * 11/2009 Safie ..... E02D 29/0258 52/302.1

(Continued)

*Primary Examiner* — Mark R Wendell
(74) *Attorney, Agent, or Firm* — Wood Herron & Evans LLP

(57) ABSTRACT

A device maintains proper downspout conductor pipe spacing and alignment. This stationary device attaches directly to the foundation of a home in any location utilizing different embodiments for straight walls, inside corners and outside corner conditions. The device provides fixtures or mounts to position the downspout accurately and reliably relative to the foundation and other components of the house or building. The device may be turned vertically in conjunction with a specifically formed soil and gravel guard to run downspout conductor pipes along the outside of a foundation before it is backfilled. By installing this system before backfilling, the installer is able to chalk line a path with consistent fall to ensure proper water flow through the pipe.

20 Claims, 16 Drawing Sheets

(56) References Cited

U.S. PATENT DOCUMENTS

| | | | | |
|---|---|---|---|---|
| 11,008,750 | B2 | 5/2021 | Moyher | |
| 2014/0117661 | A1* | 5/2014 | Harman | E04D 13/0645 285/179 |

* cited by examiner

DEVICE AND ASSOCIATED METHOD FOR DOWNSPOUT ALIGNMENT

This claims priority to U.S. Provisional Patent Application Ser. No. 63/163,984, filed Mar. 22, 2021 and hereby incorporated by reference in its entirety.

BACKGROUND OF THE INVENTION

This invention relates to a device and associated method for the alignment and positioning of a downspout relative to the associated building foundation.

A downspout (the vertical pipe that connects a gutter to a conductor pipe extending upwardly from underground) such as shown in FIG. 1A on a home or other building 3 usually tracks down a very specific vertical trim board 4, entering the downspout conductor pipe 1 (the underground pipe) just above the surface of the ground. Many contractors install underground downspout conductors 1 right up against the foundation 2 of the building 3 because all of the soil against the foundation wall 2 falls away when trenching within an inch or two of the foundation wall to set their conductor pipe 1.

The lack of foresight of what the building's finish will be above the foundation 2 often results in the conductor pipe 1, at least partially, being tucked behind the siding 5 or other structure above the foundation (See FIG. 1B) that overhangs the foundation wall 2. As such, the plumber must rework the site by digging up and adjusting pipes. This frequently results in added costs and time in the form of a plumber trip charge with the addition of two 22.5 degree fittings 6 with another section of pipe therebetween 7 (see FIG. 1C) to create adequate space for the standard 1.5" offset from the foundation to allow for the overhang that siding 5 requires. Absent such rework, the downspout conductor would be notched into the edge of the siding 5 and tucked up tight against the foundation wall 2 which would look less than professional and lead to potential issues in the future.

Ground settling around newly installed conductor pipes 1 results in pipe movement which can often create misalignment with the trim boards 4 and siding 5. As you can see in FIG. 1A, this downspout conductor 1 often falls out of true vertical by an angle identified as Alpha ($\alpha$) which may be as much as 90.2 degrees out of true vertical and out of alignment with the trim board 4 above with which the downspout will be aligned. This downspout conductor 1 will need to be fixed and realigned before gutters and downspout pipes are installed so that this installation is in alignment and straight. Another trip for the plumber to the job will cost a builder a trip charge plus a least one hour of labor to straighten this pipe 1. More costly than that is the time lost waiting to fix these issues, instead of proceeding uninterrupted with the construction of the house.

These and other problems in the prior art are addressed by this invention.

SUMMARY OF THE INVENTION

According to various embodiments of this invention a fixture and associated method maintains proper downspout alignment from below grade to above grade.

Nearly every residential, commercial and industrial building around the world captures water off the roof and diverts that water to a sewer, stream, ditch, retention area, or other location that is suitable to divert the water away from the structure upon which it was captured. For the purposes of conveying the invention, this document will primarily focus on the residential application, but one of ordinary skill will appreciate that this invention is not limited to residential applications.

All exterior construction activities are weather dependent. Various embodiments of this invention may be installed just after the footer drain tile has been back filled with gravel, so installation should never be bogged down by a sloppy or muddy site, or a yard full of construction debris that the plumber needs to move out of the way to complete the job. Ideal installation time is right after a foundation is poured (when access is easiest) before the foundation is back filled.

This invention is an apparatus designed to maintain proper downspout conductor pipe spacing and alignment. This stationary device attaches directly to the foundation of a home in any location utilizing different embodiments for straight walls, inside corners and outside corner conditions.

This invention provides fixtures or mounts to position the conductor extending from below grade accurately and reliably relative to the foundation and other components of the house or building. In other embodiments of this invention, the fixture may be turned vertically in conjunction with a specifically formed soil and gravel guard to run downspout conductor pipes along the outside of a foundation before it is backfilled. By installing this system before backfilling, this invention allows the installer to chalk line a path with consistent fall to ensure proper water flow through the pipe.

One of the purposes of the various embodiments of this invention is to ensure that a conductor pipe (that is installed in alignment with a trim board) maintains its vertical alignment with the centerline of the trim board above when the conductor pipe and the disturbed soil in the trench settle over several months. This invention ensures that this very visible transition stays straight and true long into the future.

The various embodiments of this invention would primarily be installed by exterior plumbers during the early stages of the new construction process. Both residential builders and independent contractors desiring to deliver superior quality would benefit from using this invention on new construction and renovation projects. The concept is simple enough that even private homeowners with minimal technical knowledge could install these fixtures onto the foundation of their home.

In various embodiments, the fixture of this invention is anchored to the outside of the foundation wall and has a collar through which the conductor pipe extends and an offset in the fixture provides for the desired spacing from the foundation wall.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 3:
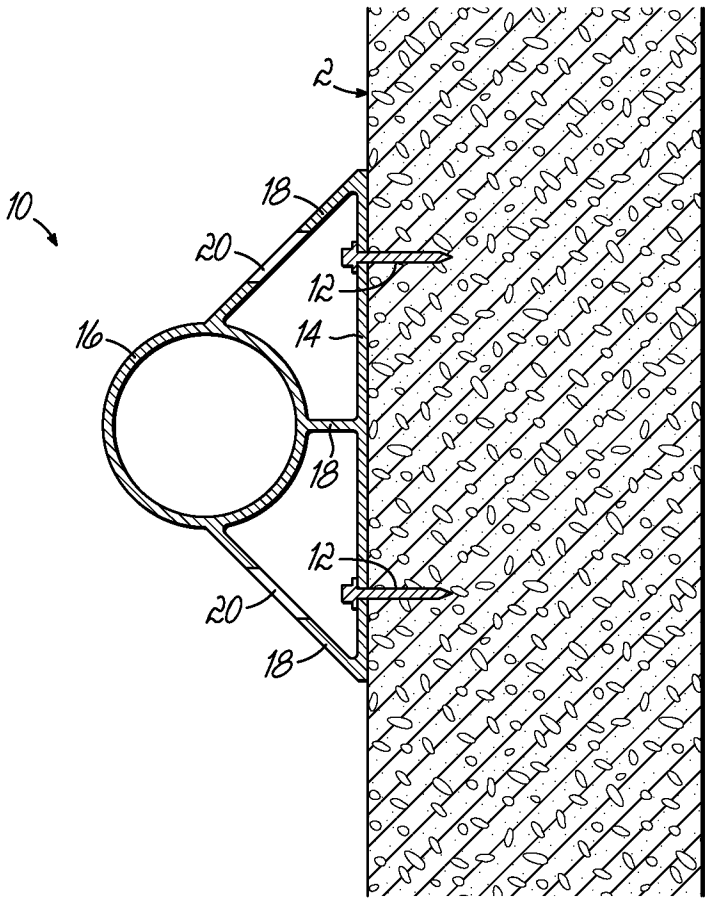
FIGS. 3-5 are top plan views of various embodiments of a fixture installed on different foundation surfaces and adapted to receive a conductor pipe therethrough for proper spacing relative to the foundation.
Figure 4:
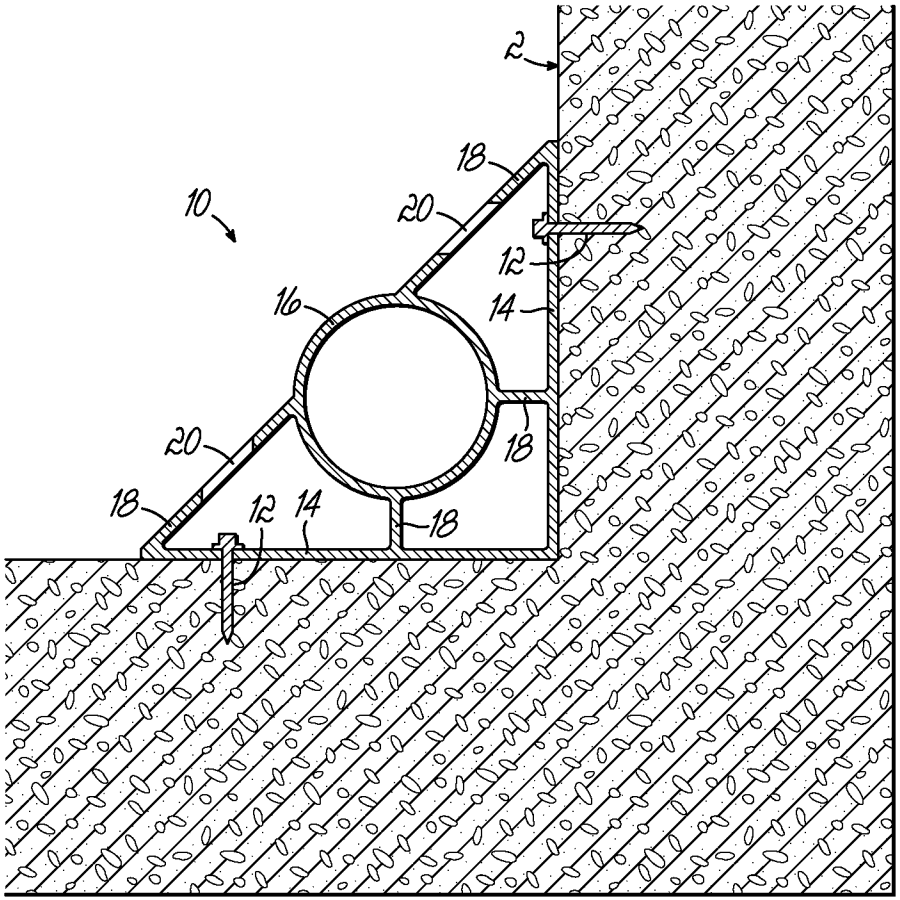
Figure 5:
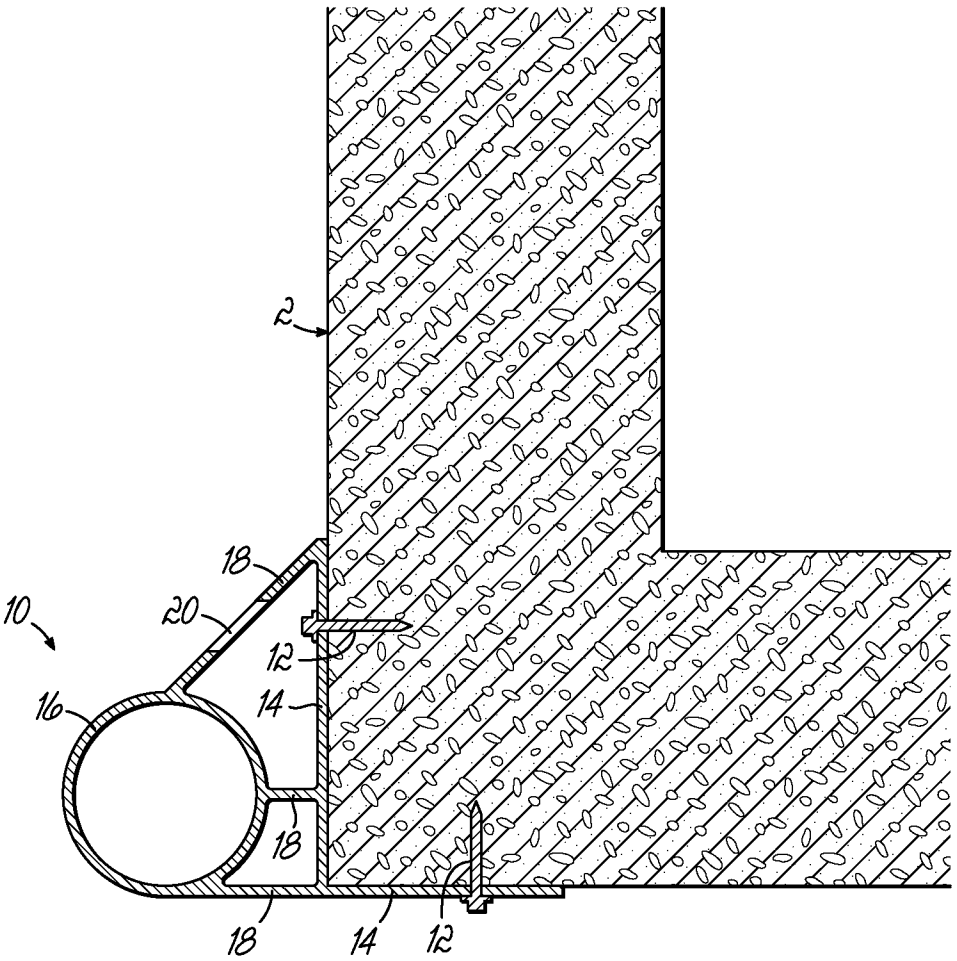
Figure 6B:
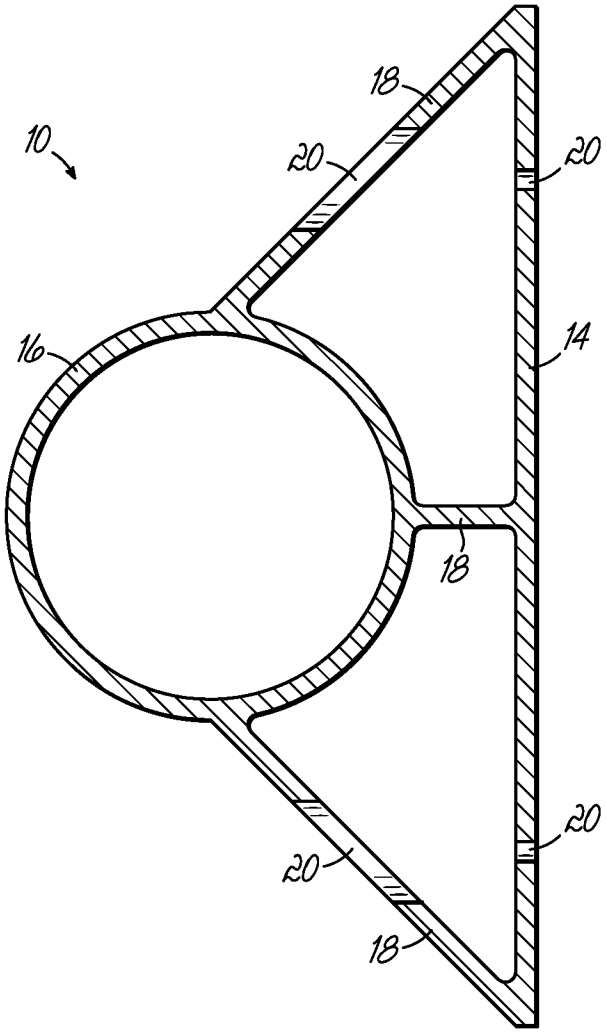
FIGS. 6A-B are schematic drawings of the fixture embodiment of FIG. 3.
Figure 6A:
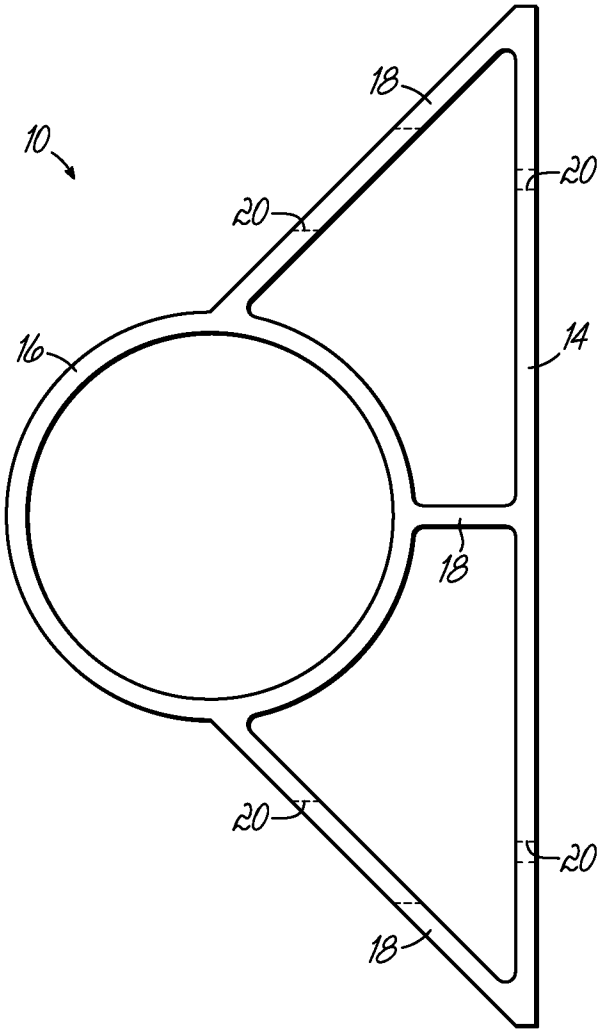
Figure 6C:
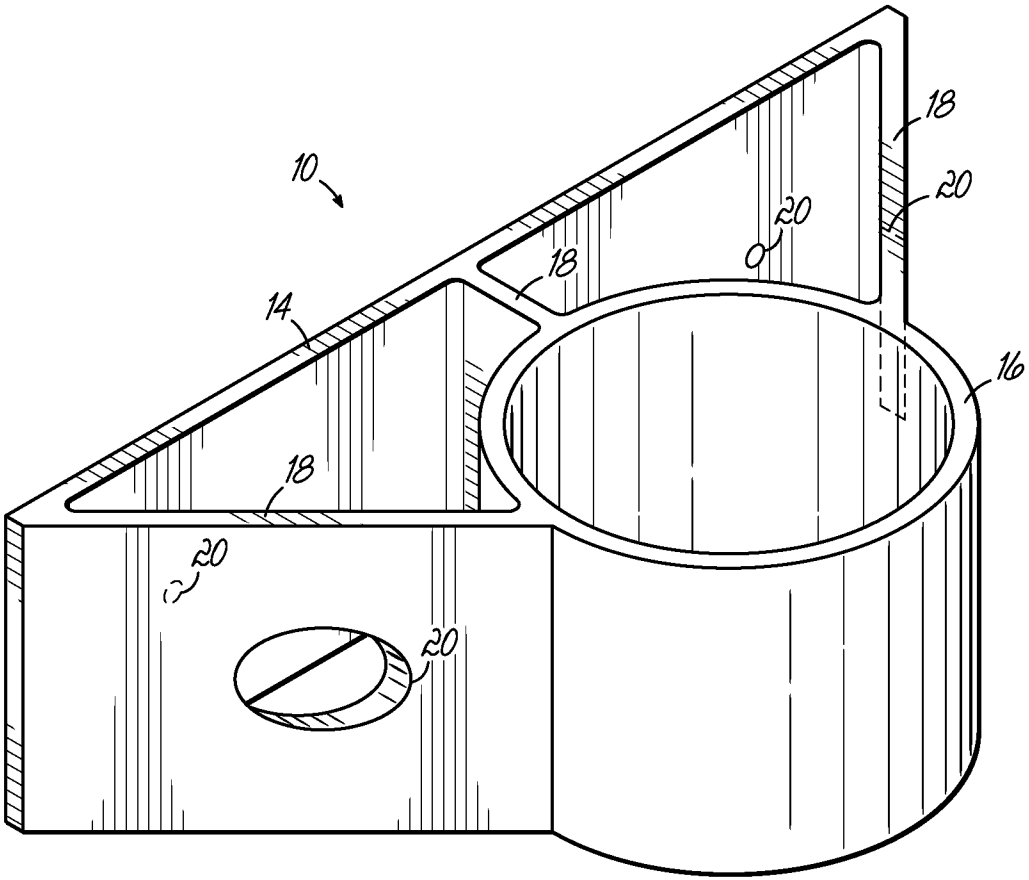
FIG. 6C is a perspective view of the fixture embodiment of FIGS. 6A-B.
Figure 7B:
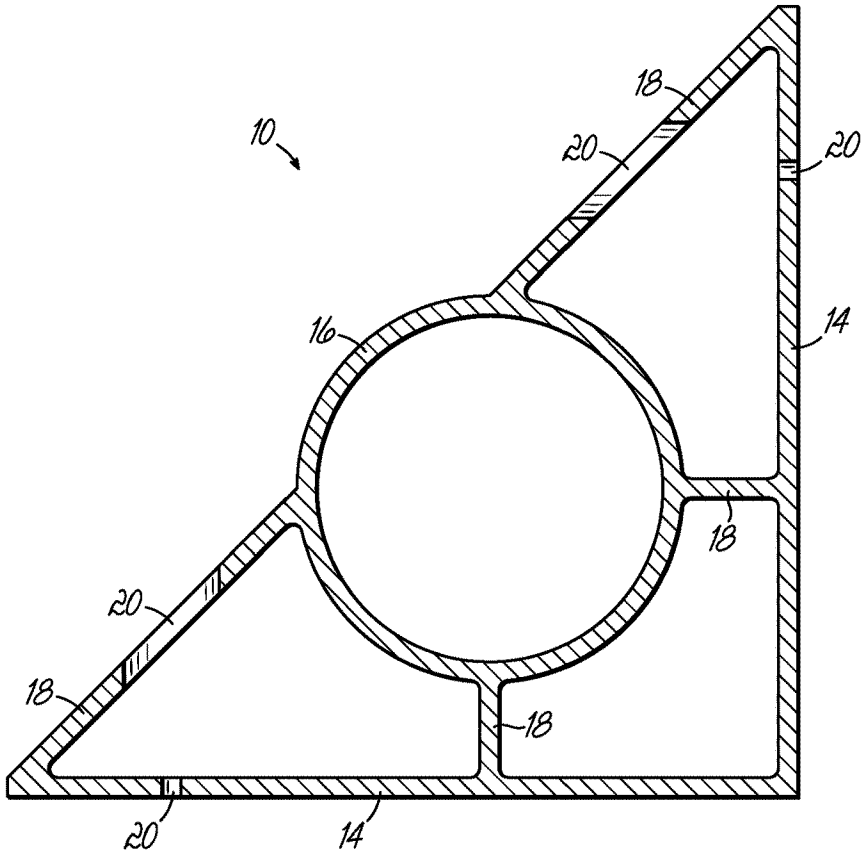
FIGS. 7A-B are schematic drawings of the fixture embodiment of FIG. 4.
Figure 7A:
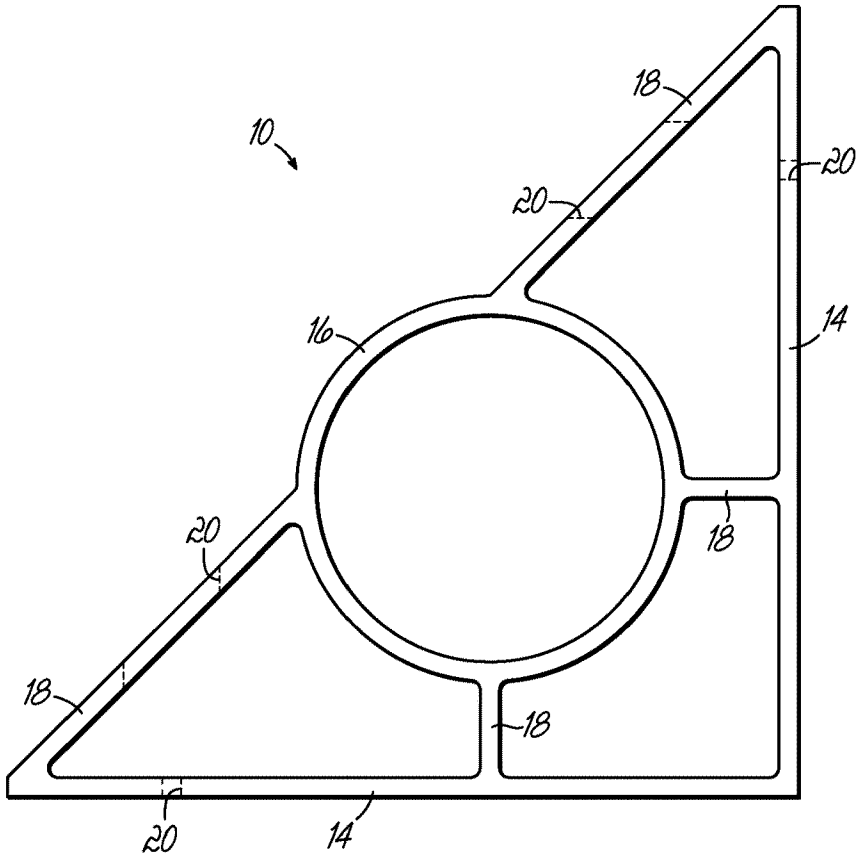
Figure 7C:
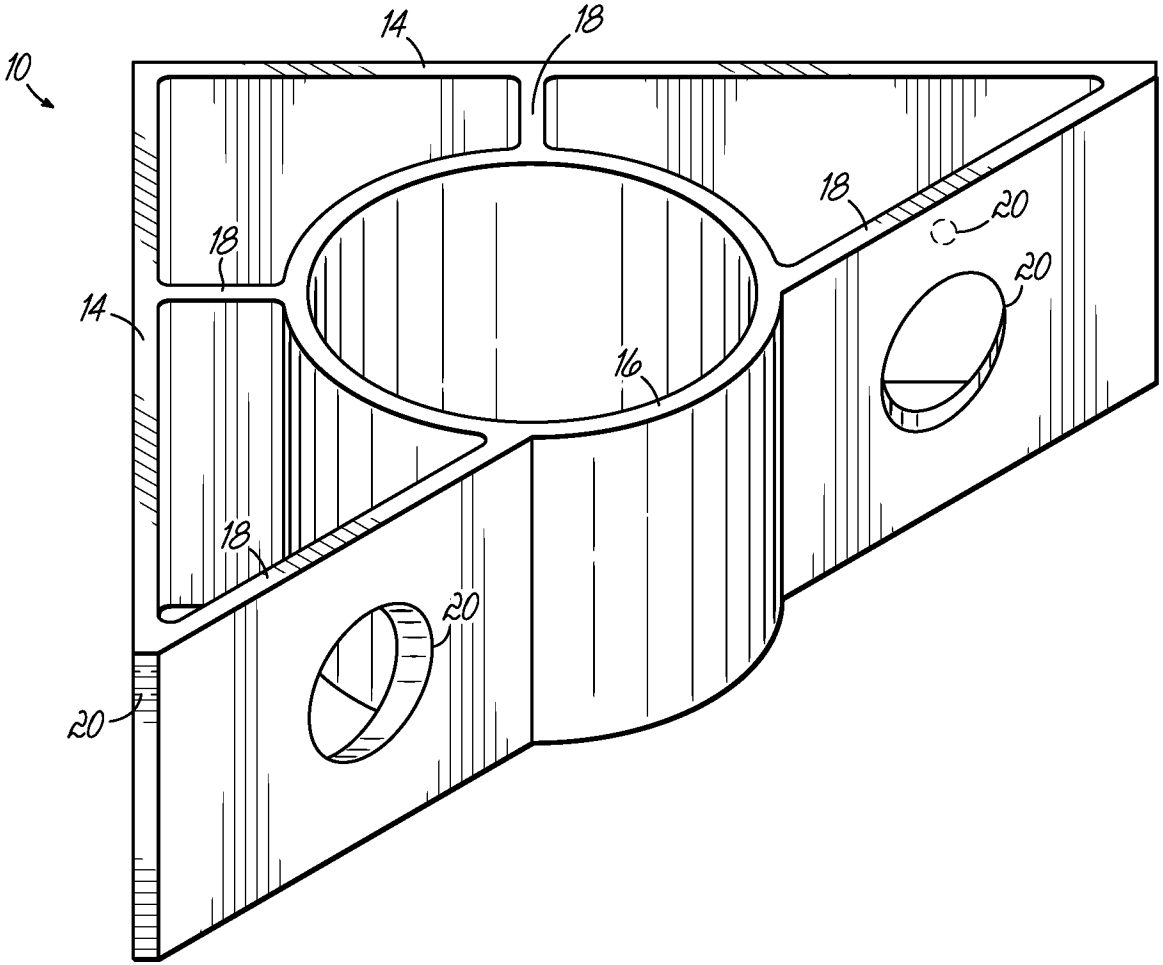
FIG. 7C is a perspective view of the fixture embodiment of FIGS. 7A-B.
Figure 8B:
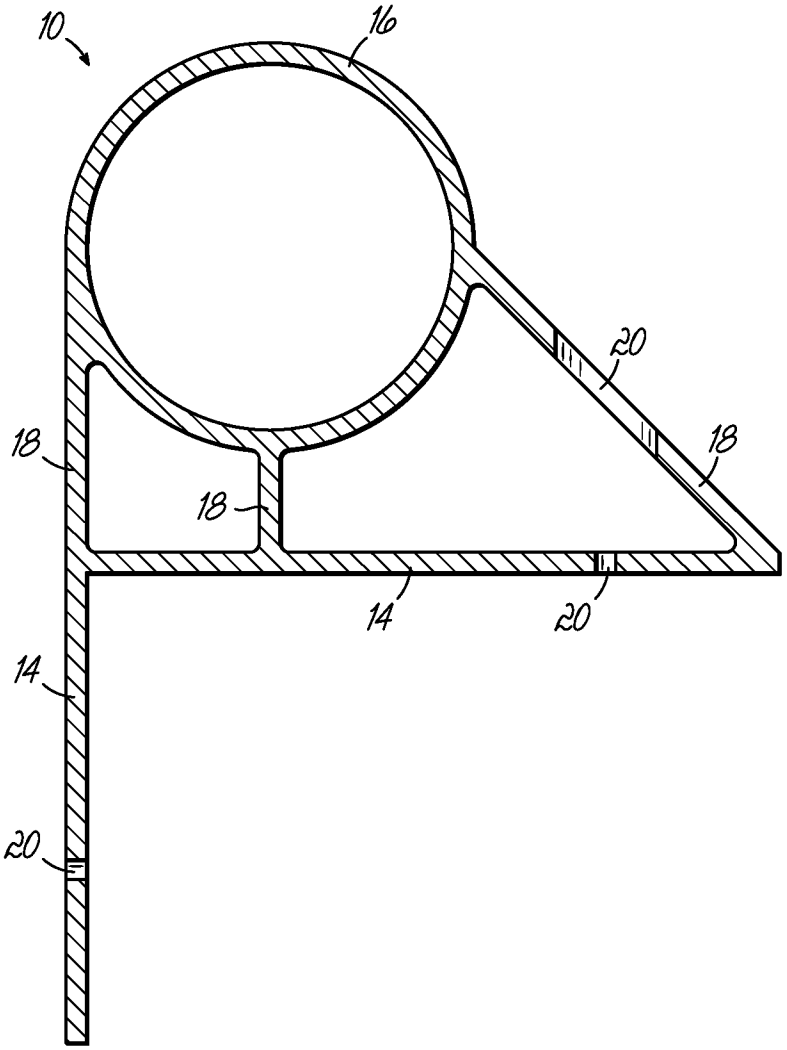
FIGS. 8A-B are schematic drawings of the fixture embodiment of FIG. 5.
Figure 8A:
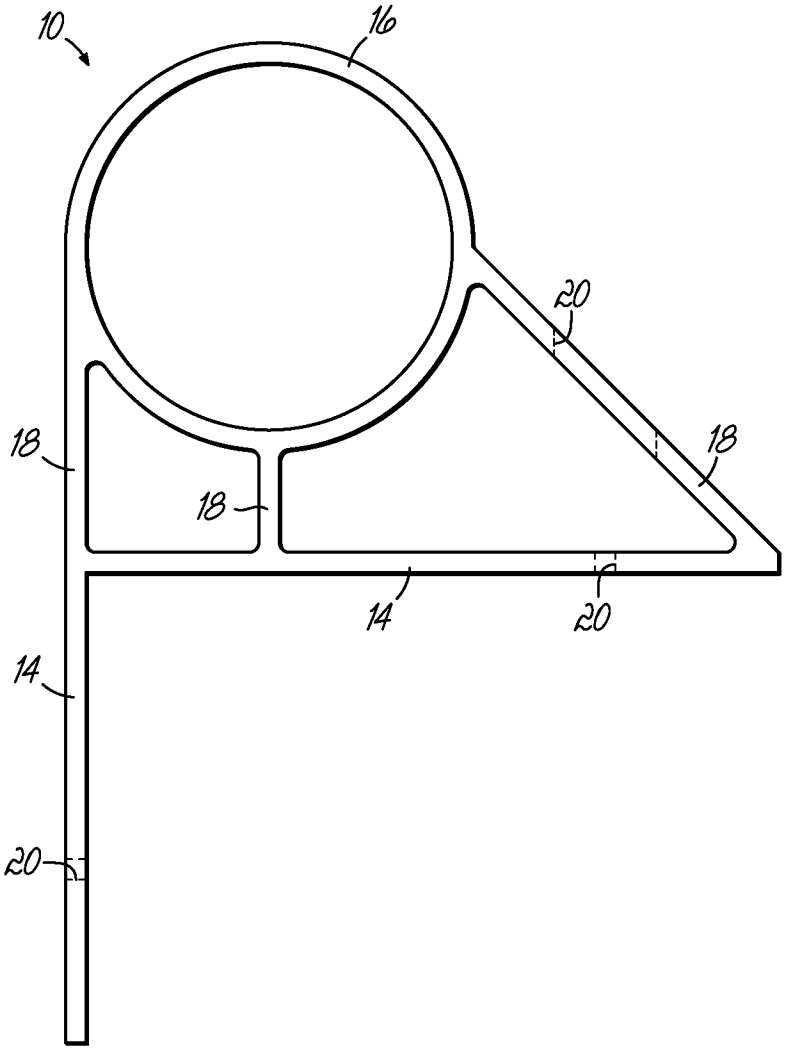
Figure 8C:
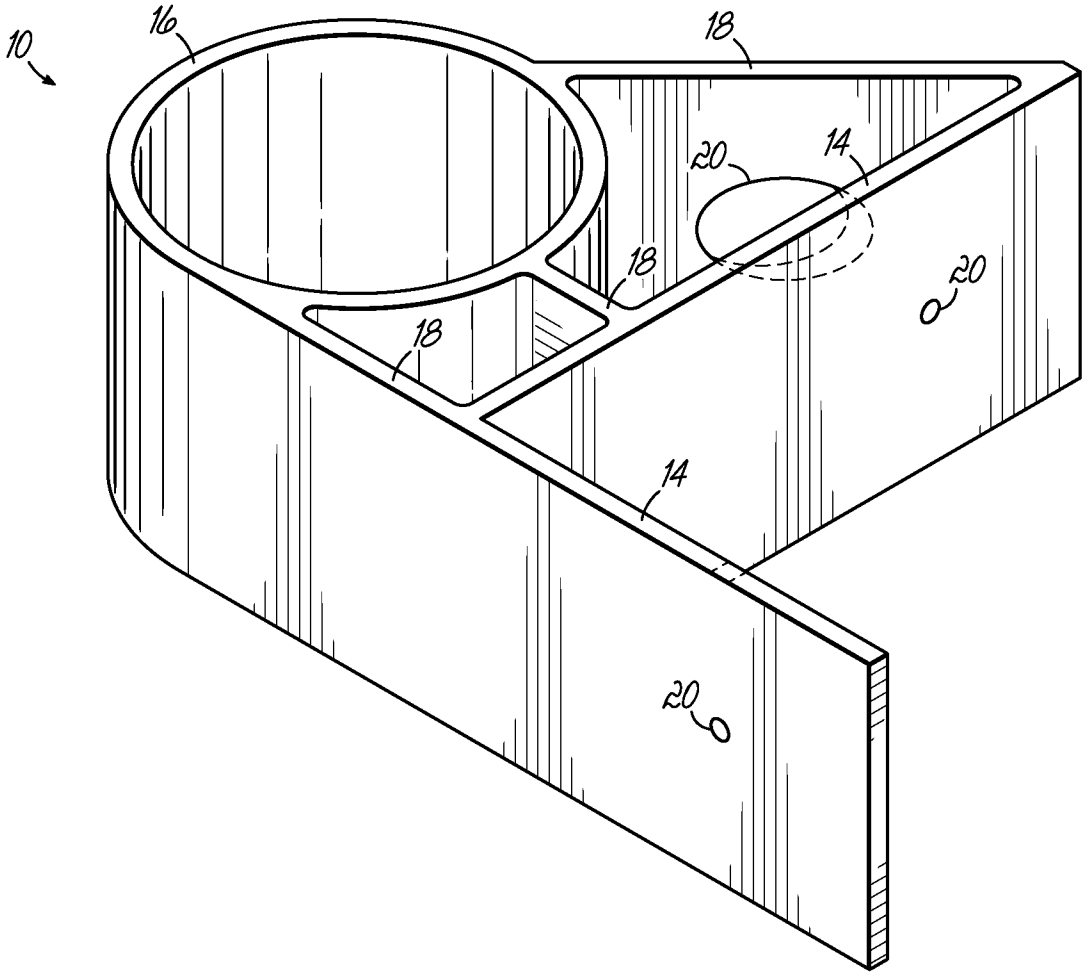
FIG. 8C is a perspective view of the fixture embodiment of FIGS. 8A-B.

According to various embodiments of this invention, a fixture 10 and associated method of a construction related product enhances construction accuracy and durability. Referring to FIGS. 3-5, various embodiments of a fixture 10 according to this invention are shown anchored to the foundation 2. The fixture 10 may be anchored to the foundation by anchor bolts 12 or other appropriate mechanical anchors. The fixture 10 may include a mount portion 14 which is juxtaposed to the foundation 2. The mount portion 14 may be a planar plate as in FIG. 3 or a pair of orthogonal plates for an inside corner of the foundation 2 (FIG. 4) or an outside corner of the foundation 2 (FIG. 5). The fixture 10 may also have a coupling member to couple the fixture to the conductor pipe 1. In one embodiment, the coupling member is a collar 16 in the form of a sleeve or other member for securing the fixture 10 to a conductor pipe 1. The conductor pipe 1 extends through the collar 16 in the embodiments of FIGS. 3-5. The fixture 10 may also have one or more offset members 18 for spacing the collar 16 and pipe 1 extending therethrough from the foundation 2. The fixture 10 may also include one or more holes 20 for the anchors 12 to extend through the offset members 18 and the mount portion 14 to secure the fixture 10 to the foundation 2.

The fixture 10 in some embodiments is secured to the foundation wall 2 with two anchor bolts 12. It only takes but a minute or two to hammer drill the holes in the foundation 2 for the anchor bolts 12 to anchor into. One of ordinary skill in this art will appreciate that other devices and/or means may be used to secure the fixture 10 to the foundation 2 within the scope of this invention.

Another purpose of this invention is to ensure that proper spacing is maintained between a conductor pipe 1 and the foundation wall 2 to eliminate conflicts above with porch slab overhangs or exterior siding, trim, brick and stone that often hang out beyond the foundation wall. The conductor pipe 1 may be part of a water management system installed on the building 3. In some embodiments, the conductor pipe 1 is a downspout pipe to transmit water collected by roof mounted gutters away from the building 3 and foundation 2. However, the fixture 10 and other aspects of this invention are not limited to a downspout as part of a water management system for the building 3.

Figure 1A:
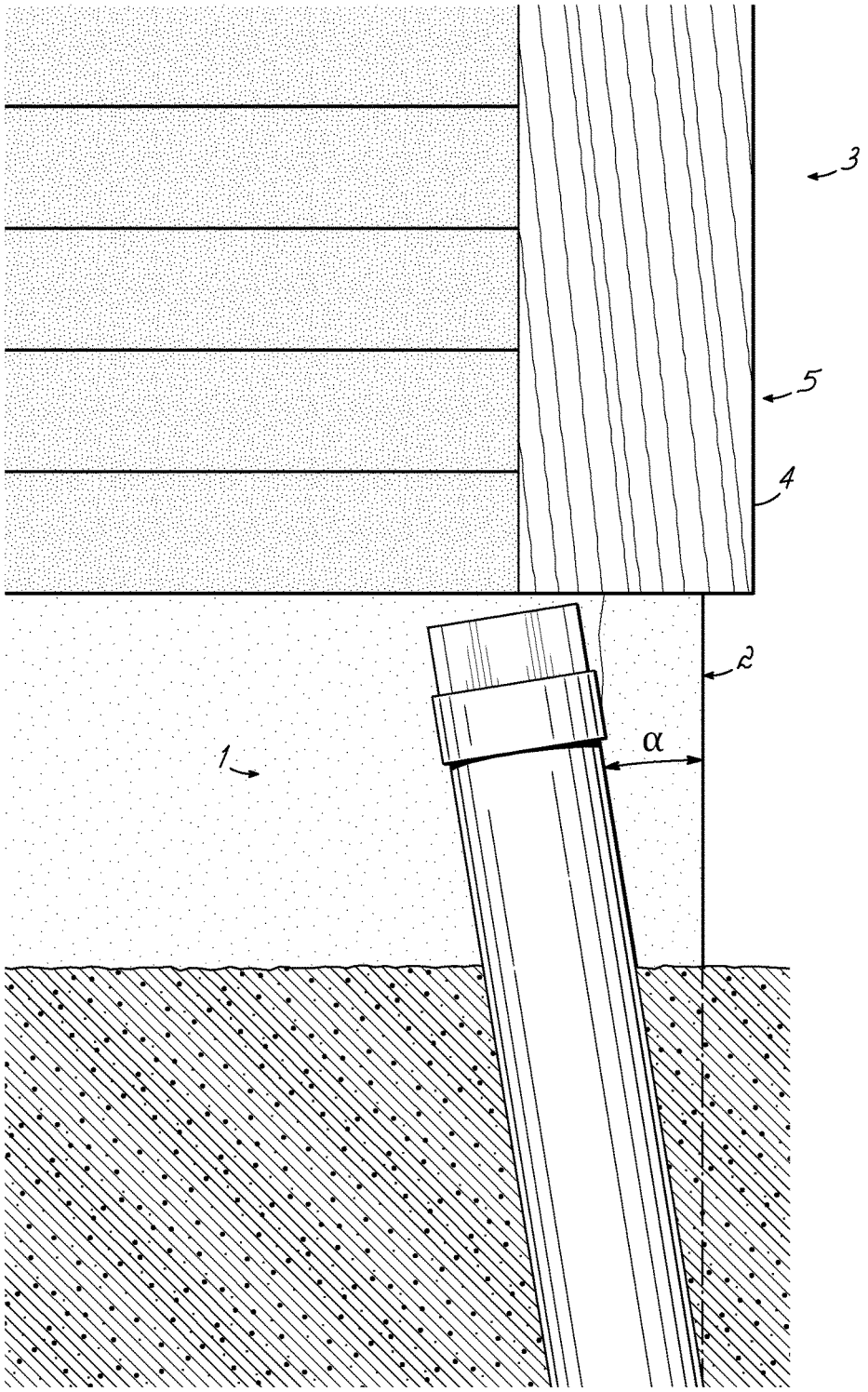
FIG. 1A is a prior art downspout pipe misaligned with a trim board demonstrating the need for this invention.
Figure 1B:
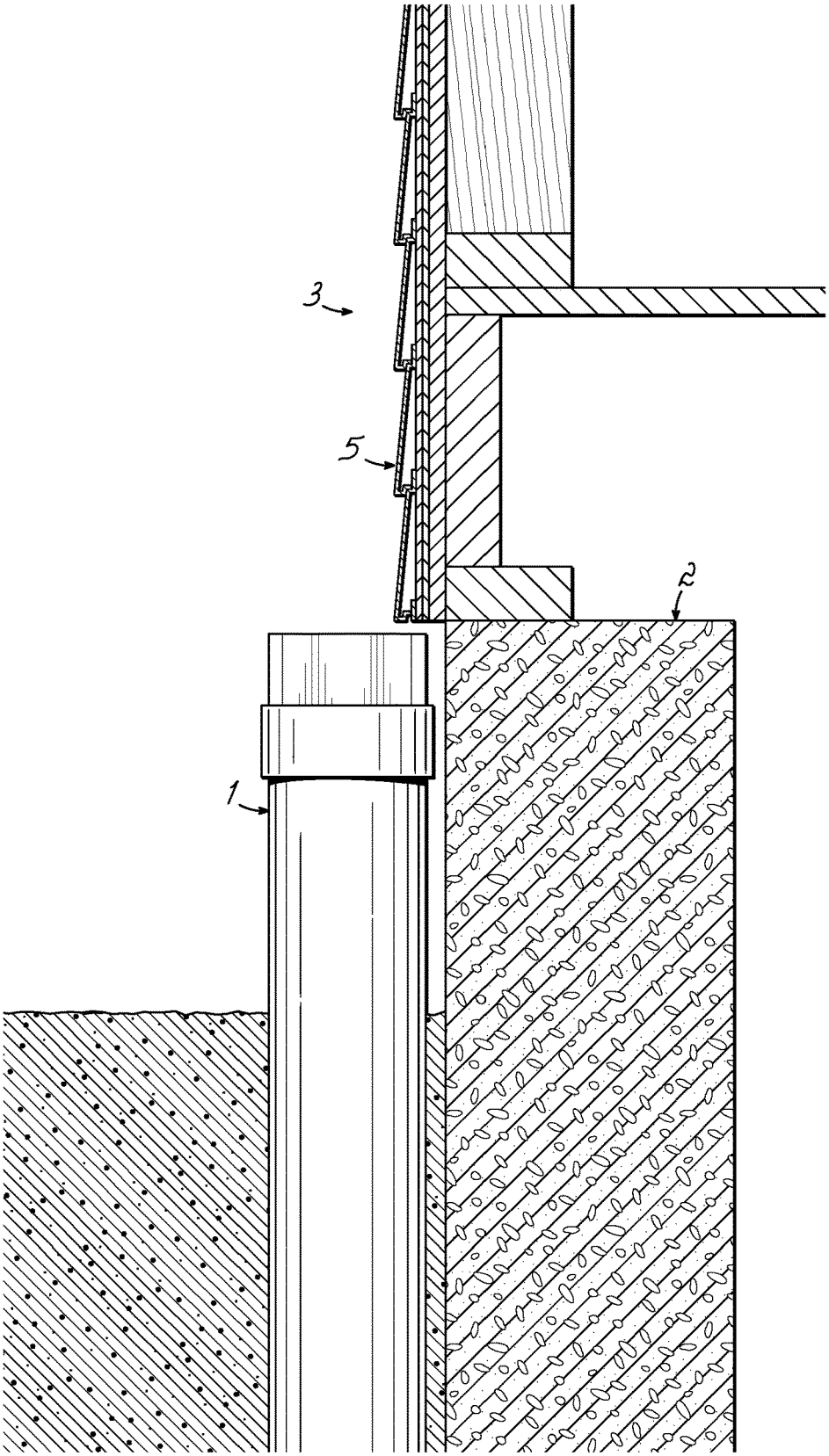
FIG. 1B is a prior art downspout pipe installed too close to the foundation failing to provide for proper clearance with the siding there above and demonstrating the need for this invention.
Figure 1C:
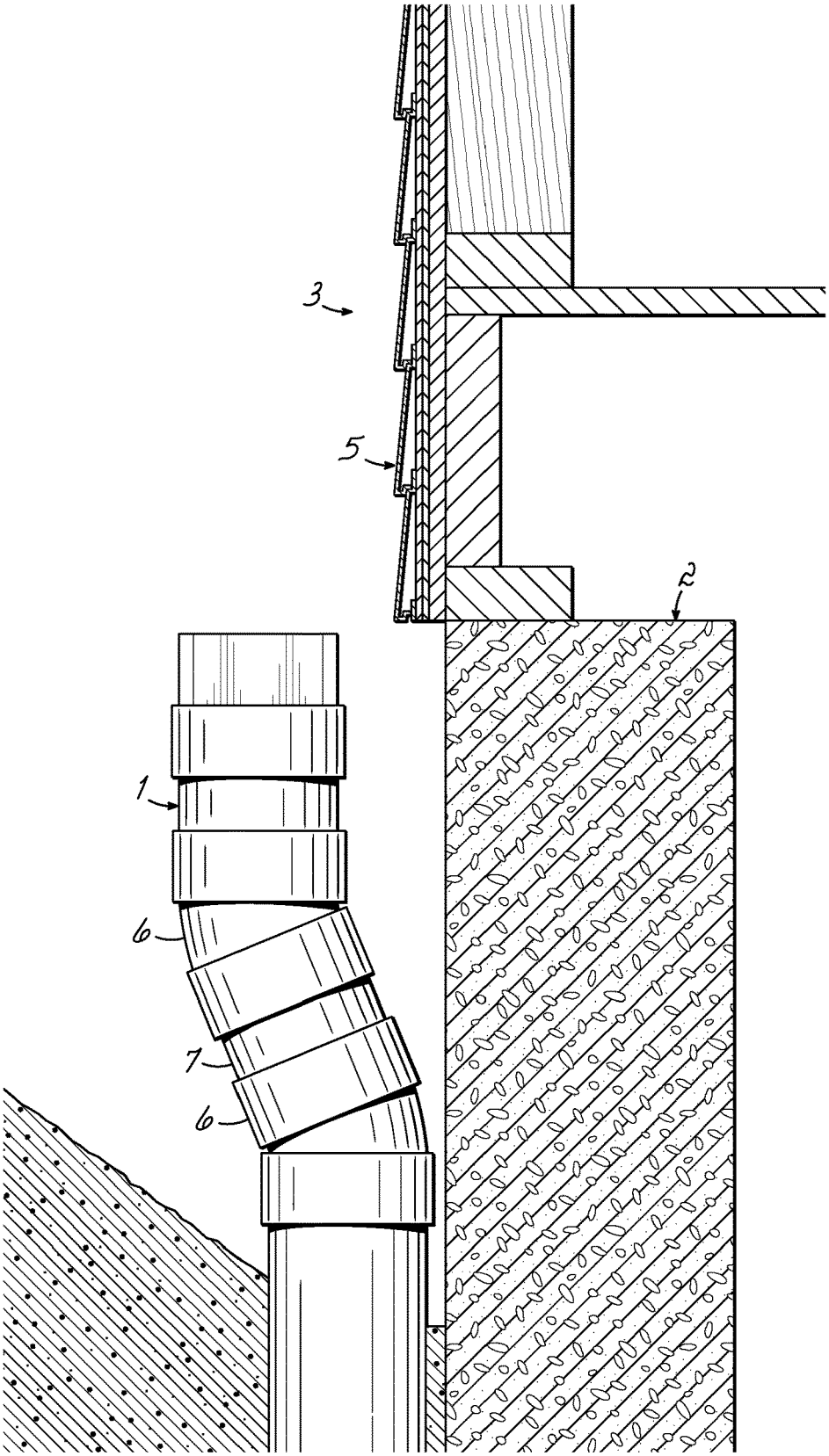
FIG. 1C is an example of a prior art rework to address the problems in the prior art utilizing multiple added connectors to provide for adequate spacing of the conductor pipe relative to the foundation.
Figure 2:
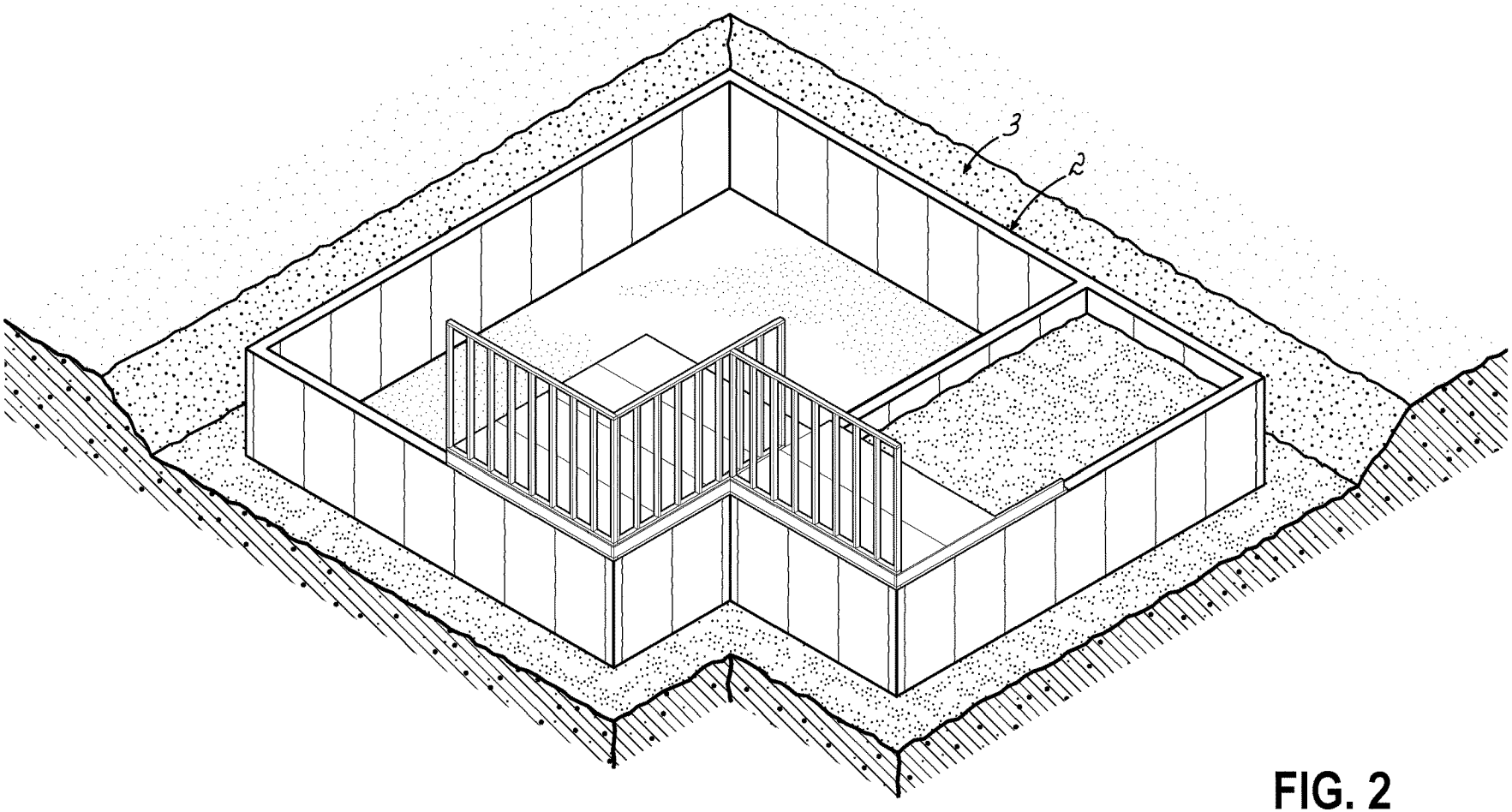
FIG. 2 is an exemplary poured concrete foundation before backfilling is added there around.
Figure 9A:
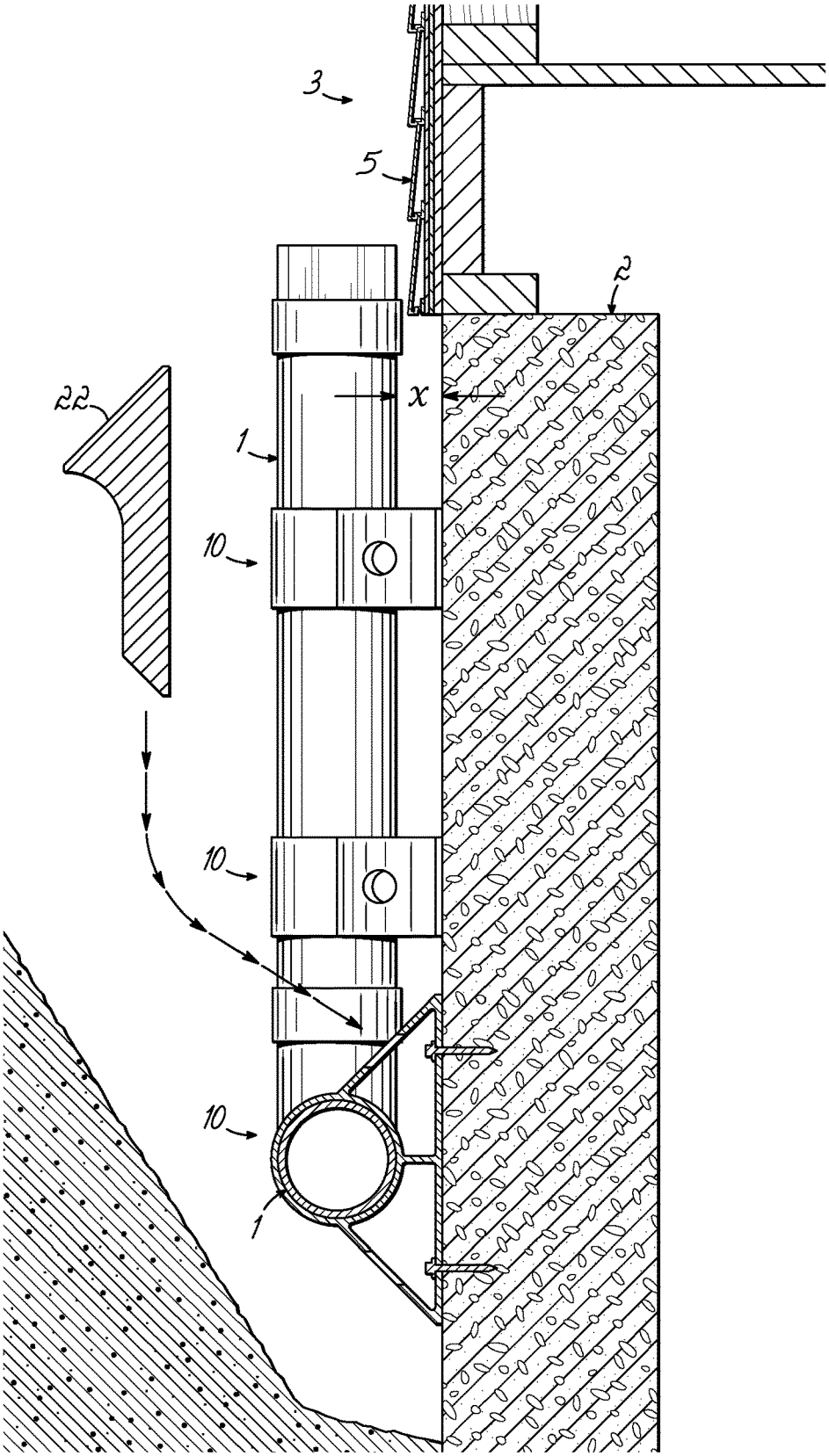
FIGS. 9A-C are schematic views of an exemplary installation on a foundation wall of various embodiments of this invention.

As shown in FIG. 9A, the fixture 10 of various embodiments of this invention maintains the generally linear conductor pipe 1 parallel to the outer face of the foundation 2 a spaced distance X from the foundation 2 so as to avoid interference with building components such as siding 5 or other building components located above the foundation 2 while maintaining the conductor pipe 1 in a generally vertical and linear orientation. The conductor pipe 1 does not need to be modified (i.e., as shown in FIG. 1C) or diverted away from a generally vertical trajectory to avoid the siding 5 or other building components above the foundation because the fixture 10 accurately positions the conductor pipe 1 in a desired spaced position relative to the foundation 2. Backfill around the foundation 2 does not alter the position of the conductor pipe 1 secured to the foundation 2 by the fixture 10 according to various embodiments of this invention.

Figure 9B:
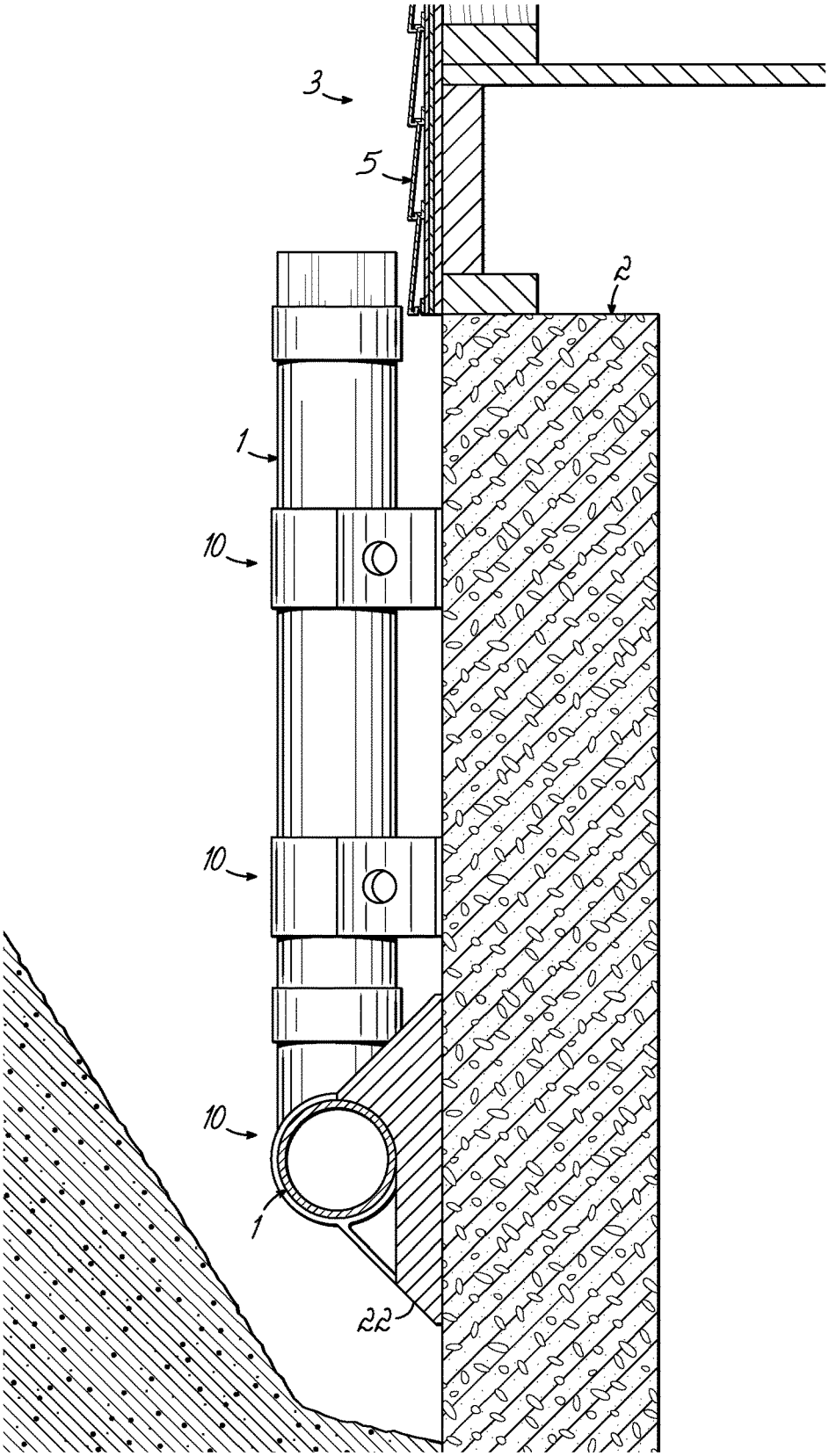
Figure 9C:
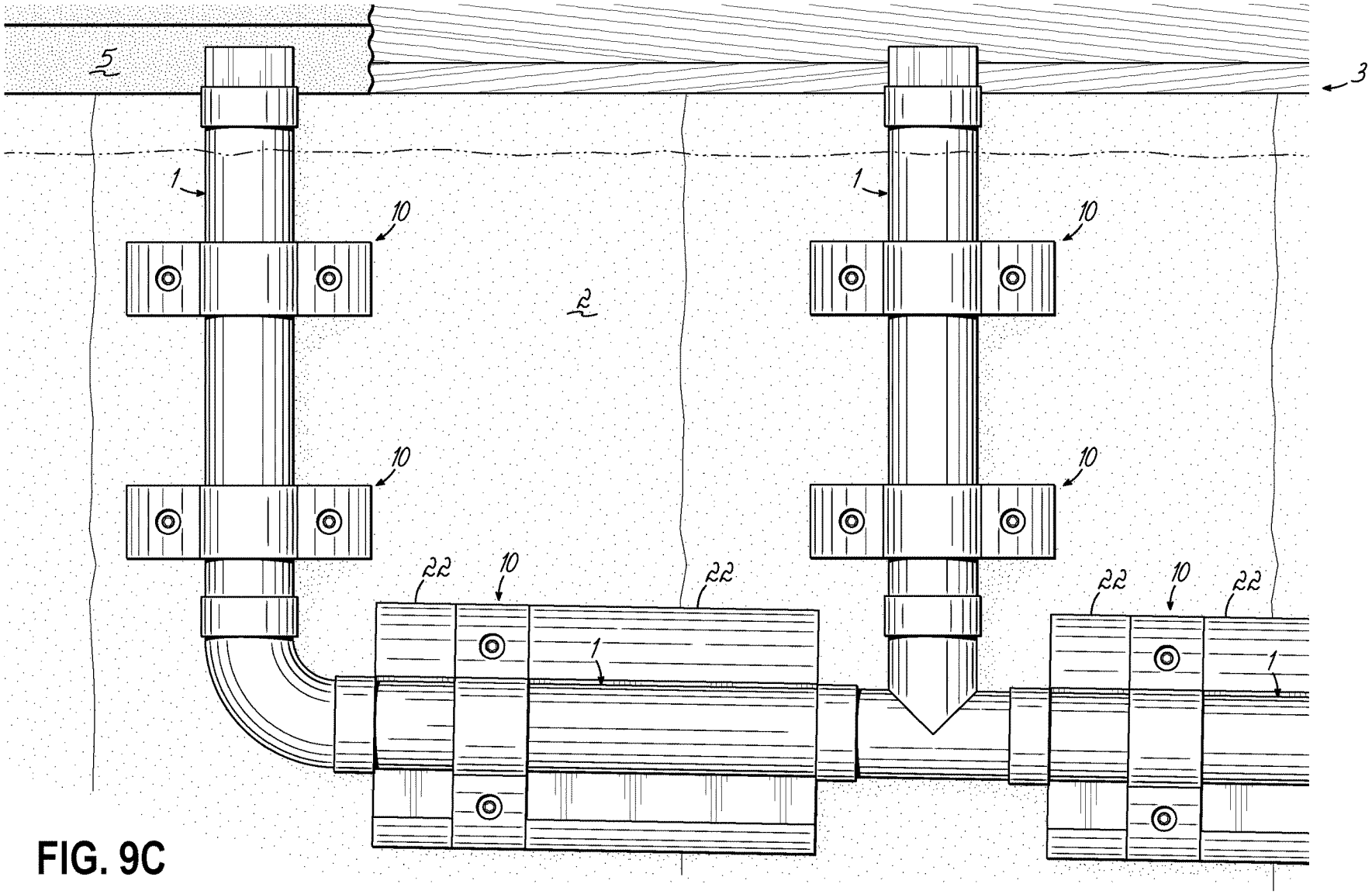

The fixture 10 could be produced much in the same way that a PVC pipe fitting is currently molded in a metal mold. The design would simply be enhanced to maximize strength and achieve the specific goals of this product. This invention also helps maintain vertical pipe alignment preventing pipe settling and twisting. This maintains a truer visual appearance on the building 3 for many years into the future. Another aspect of this invention is a diverter 22 as shown in FIGS. 9A-C. The diverter 22 is installed with the fixture 10 to inhibit backfill dirt, rocks, gravel and the like from falling between the conductor pipe 1 and the foundation 2 and thereby making the horizontal conductor pipe 1 sag and lose proper/consistent fall. In various embodiments, the diverter 22 is installed into the upper portion of the downspout conductor 1 as shown in FIG. 9A-C. The diverter 22 may take any of a variety of shapes, sizes and configurations within the scope of this invention. The diverter 22 may be molded, cast or formed into the shape shown in FIG. 9A or another shape to allow the diverter 22 to be mounted in conjunction with the fixture 10 proximate the foundation.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A fixture for securing a conductor pipe to a building foundation comprising:

a mount juxtaposed to the building foundation and adapted to receive at least one fastener to secure the fixture to the building foundation;

a coupling member adapted to secure the conductor pipe to the fixture; and an offset member sized and configured to position the conductor pipe when secured to the fixture by the coupling member a desired distance away from the building foundation so as to align a vertically upwardly directed portion of the conductor pipe and avoid interference with a building component located superjacent the foundation.

2. The fixture of claim 1 wherein the mount further comprises:

a generally planar member juxtaposed in face to face contact with a generally planar face of the foundation.

3. The fixture of claim 1 wherein the mount further comprises:

a first generally planar member juxtaposed in face to face contact with a first generally planar face of the building foundation; and a second generally planar member juxtaposed in face to face contact with a second generally planar face of the building foundation;

wherein the first and second generally planar members are perpendicular to each other.

4. The fixture of claim 3 wherein the fixture is adapted to mounted to one of an inside corner and an outside corner of the building foundation.

5. The fixture of claim 1 wherein the coupling member further comprises:

a collar which at least partially engages an outer surface of the conductor pipe.

6. The fixture of claim 5 wherein the collar entirely surrounds the outer surface of a portion of the conduit pipe.

7. The fixture of claim 6 wherein a cross-sectional configuration of the collar is generally circular.

8. The fixture of claim 1 wherein the offset member is at least one rib joining the offset member to the mount.

9. The fixture of claim 8 further comprising a plurality of ribs spaced from one another.

10. The fixture of claim 9 wherein at least some of the plurality of ribs are non-parallel with each other.

11. The fixture of claim 1 wherein the fixture is secured to the building foundation with at least one mechanical fastener, the fixture further comprising:

an access hole in the offset member to provide for access for the at least one mechanical fastener to secure the mount to the building foundation.

12. The fixture of claim 1 wherein the conductor pipe is oriented one of generally vertical and generally horizontal.

13. A fixture for securing a conductor pipe to a building foundation comprising:

a mount juxtaposed to the building foundation and adapted to receive at least one fastener to secure the fixture to the building foundation, the mount including a generally planar member juxtaposed in face to face contact with a generally planar face of the foundation;

a coupling member adapted to secure the conductor pipe to the fixture, the coupling member being a collar which at least partially engages an outer surface of the conductor pipe; and an offset member sized and configured to position the conductor pipe when secured to the fixture by the coupling member a desired distance away from the building foundation so as to align a vertically upwardly directed portion of the conductor pipe and avoid interference with a building component located superjacent the foundation, the offset member being at least one rib joining the offset member to the mount.

14. The fixture of claim 13 wherein the mount further comprises:

a first generally planar member juxtaposed in face to face contact with a first generally planar face of the building foundation; and a second generally planar member juxtaposed in face to face contact with a second generally planar face of the building foundation;

wherein the first and second generally planar members are perpendicular to each other and the fixture is adapted to mounted to one of an inside corner and an outside corner of the building foundation.

15. The fixture of claim 13 wherein the collar entirely surrounds the outer surface of a portion of the conduit pipe.

16. The fixture of claim 13 further comprising a plurality of ribs spaced from one another and at least some of the plurality of ribs are non-parallel with each other.

17. The fixture of claim 13 wherein the fixture is secured to the building foundation with at least one mechanical fastener, the fixture further comprising:

an access hole in the offset member to provide for access for the at least one mechanical fastener to secure the mount to the building foundation.

18. An installation comprising:

a building foundation having a generally planar outer surface and being below ground level;

at least one building component supported atop the building foundation and projecting horizontally beyond the outer surface of the building foundation;

a generally linear and vertically oriented conductor pipe having a first portion confronting the outer surface of the building foundation and a second portion confronting the at least one building component;

a fixture mounted to the outer surface of the building foundation and coupled to the first portion of the conductor pipe, wherein the fixture further comprises, (a) a mount juxtaposed to the outer surface of the building foundation and adapted to receive at least one fastener to secure the fixture to the building foundation;

(b) a coupling member adapted to secure the conductor pipe to the fixture; and (c) an offset member sized and configured to position the conductor pipe when secured to the fixture by the coupling member a desired distance away from the outer surface of the building foundation so as to align vertically the first and second portions of the conductor pipe and avoid interference with the at least one building component located superjacent the foundation.

19. The installation of claim 18 wherein backfill material surrounds the fixture and at least part of the first portion of the conductor pipe, the installation further comprising:

a diverter positioned superjacent to the fixture to divert the backfill material around the fixture.

20. The installation of claim 18 wherein the mount further comprises a generally planar member juxtaposed in face to face contact with a generally planar face of the foundation;

wherein the coupling member further comprises a collar which at least partially engages an outer surface of the conductor pipe;

wherein the offset member is at least one rib joining the offset member to the mount; and wherein the fixture is secured to the building foundation with at least one mechanical fastener and the fixture further comprises an access hole in the offset member to provide for access for the at least one mechanical fastener to secure the mount to the building foundation.

* * * * *